US008882853B2

(12) United States Patent
Son et al.

(10) Patent No.: US 8,882,853 B2
(45) Date of Patent: Nov. 11, 2014

(54) ENVIRONMENTALLY-FRIENDLY SOLVENT FOR WASHING AND DRY-CLEANING, AND LAUNDRY COMPOSITION INCLUDING THE SAME

(75) Inventors: Seong-Kil Son, Daejeon (KR); Kyoung-Hee Oh, Daejeon (KR); Hyo-Seon Kim, Seoul (KR); Jung-Jin Choi, Daejeon (KR); Sug-Youn Chang, Seoul (KR)

(73) Assignee: LG Household & Health Care Ltd., Seoul (KR)

( * ) Notice: Subject to any disclaimer, the term of this patent is extended or adjusted under 35 U.S.C. 154(b) by 0 days.

(21) Appl. No.: 14/003,999

(22) PCT Filed: Dec. 15, 2011

(86) PCT No.: PCT/KR2011/009683

§ 371 (c)(1), (2), (4) Date: Sep. 9, 2013

(87) PCT Pub. No.: WO2012/121475

PCT Pub. Date: Sep. 13, 2012

(65) Prior Publication Data

US 2013/0345107 A1 Dec. 26, 2013

(30) Foreign Application Priority Data

Mar. 8, 2011 (KR) ..... 10-2011-0020345
Oct. 24, 2011 (KR) ..... 10-2011-0108903

(51) Int. Cl.

| | |
|---|---|
| ***B08B 3/04*** | (2006.01) |
| ***C11D 7/26*** | (2006.01) |
| ***C11D 7/50*** | (2006.01) |
| ***D06L 1/02*** | (2006.01) |
| ***C11D 3/20*** | (2006.01) |
| ***C11D 3/43*** | (2006.01) |

(52) U.S. Cl.

CPC ..... *C11D 7/5022* (2013.01); *D06L 1/02* (2013.01); *C11D 3/2096* (2013.01); *C11D 3/43* (2013.01)

USPC ..... 8/137; 8/142; 510/276; 510/285; 510/505; 510/506

(58) Field of Classification Search

USPC ..... 510/276, 285, 505, 506; 8/137, 142

See application file for complete search history.

(56) References Cited

U.S. PATENT DOCUMENTS

| | | | | |
|---|---|---|---|---|
| 4,575,558 | A * | 3/1986 | Mai et al. | 549/453 |
| 2010/0137480 | A1 * | 6/2010 | Denilson et al. | 524/108 |

FOREIGN PATENT DOCUMENTS

| | | | |
|---|---|---|---|
| JP | 6346093 | A | 12/1994 |
| JP | 2001354998 | A | 12/2001 |
| KR | 19950003429 | A | 2/1995 |
| KR | 20000064431 | A | 11/2000 |
| KR | 20050019088 | A | 2/2005 |

OTHER PUBLICATIONS

International Search Report for Appl No. PCT/KR2011/009683 mailed Jul. 11, 2012 (2 pages).

* cited by examiner

*Primary Examiner* — Brian P Mruk

(74) *Attorney, Agent, or Firm* — Nutter McClennen & Fish LLP; John J. Penny, Jr.

(57) ABSTRACT

The present invention relates to a solvent for cleaning textiles or clothes. The present invention provides a solvent for cleaning which has a specified formula that is safe on the human body and environment, as well as good cleaning ability against oil-based and water-based contaminants and can be quickly dried. The solvent of the present invention and a composition comprising the same can be effectively used to water clean or dry clean textiles or clothes at home.

8 Claims, 1 Drawing Sheet

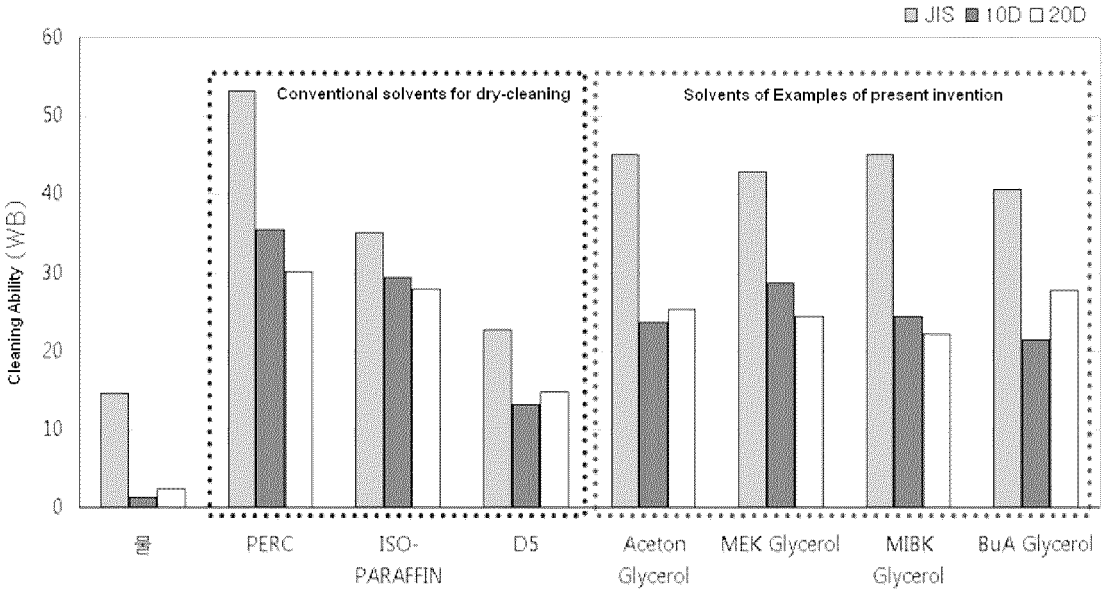
JIS
10D
20D
Cleaning Ability (WB)
60
50
40
30
20
10
0
Conventional solvents for dry-cleaning
Solvents of Examples of present invention
물
PERC
ISO-PARAFFIN
D5
Aceton Glycerol
MEK Glycerol
MIBK Glycerol
BuA Glycerol

ENVIRONMENTALLY-FRIENDLY SOLVENT FOR WASHING AND DRY-CLEANING, AND LAUNDRY COMPOSITION INCLUDING THE SAME

TECHNICAL FIELD

The present invention relates to a solvent for cleaning, e.g., water-cleaning and dry-cleaning of textiles and clothes, and a composition for water-cleaning or dry-cleaning, which comprises the solvent.

This application claims priority to Korean Patent Application No. 10-2011-0020345 filed in the Republic of Korea on Mar. 8, 2011, the entire contents of which are incorporated herein by reference.

This application also claims priority to Korean Patent Application No. 10-2011-0108903 filed in the Republic of Korea on Oct. 24, 2011, the entire contents of which are incorporated herein by reference.

This application also claims priority to International Application No. PCT/KR2011/009683 filed on Dec. 15, 2011, the entire contents of which are incorporated herein by reference

BACKGROUND

The cleaning process of textiles and clothes generally refers to the removal of contaminants therefrom, and can largely be divided into two categories. One is a general water-cleaning process comprising dispersing a surfactant in water to increase an alkalinity degree of water and remove contaminants from textiles and clothes, then rinsing the textiles and clothes, followed by wringing and drying. The other is a dry-cleaning process used to clean delicate fabrics (e.g., natural protein fabrics such as wool and silk, artificial silk, and acetate fiber) that cannot withstand the alkaline cleaning conditions as mentioned above, and the long term rough and tumble of a washing machine which can cause significant wear and tear, stress and distortion, causing the fibers to damage, break, shrink, and become irreversibly matted. The dry-cleaning uses solvents, for example, petroleum-based solvents, chlorinated solvents, glycol ester-based solvents, cyclic silicone- or silicone-based solvents, fluorinated solvents, and terpene oil such as limonene so as to dissolve and remove oil-based contaminants, and the used solvents are removed from the fabrics by a physical method and volatilized by drying.

The water-cleaning process (general cleaning method), which uses a general detergent and plenty of water, is effective in removing water-based contaminants, but is limited in the removal of oil-based contaminants. Also, due to the alkaline cleaning conditions and the long term rough and tumble of a washing machine, significant wear and tear, stress and distortion cause the fibers to damage, break, shrink, and become irreversibly matted.

Recently, in order to prevent the damage and distortion of clothes caused by the use of alkaline detergents, neutral liquid detergents are commercially available. However, since the neutral liquid detergents require mixing with water before use, the damage and distortion of clothes caused by the water cannot be prevented.

Meanwhile, to prevent the disadvantages of water cleaning such as the damage and distortion of clothes caused by the water cleaning process above, dry cleaning is often used. However, this dry cleaning process is effective in removing oil-based contaminants but is limited in the removal of water based contaminants. Also, since dry-cleaning mostly uses a chemical solvent that is harmful to the human body and environment, it should be carried out in a closed washing system that is very expensive and requires complicated maintenance.

In dry-cleaning, different kinds of soaps obtained by mixing various ionic surfactants, e.g., nonionic, anionic, cationic or amphoteric surfactants with trace amounts of water have been used as a component for improving such a limitation in the removal of water-based contaminants. Such soap is added to a solvent for dry-cleaning in trace amounts for laundry. However, as the solvent for dry-cleaning has low affinity with water, there is a limitation in the amount of soap to be used, and therefore, it is still difficult to remove water-based contaminants.

Various solvents for dry-cleaning have the following characteristics. Chlorinated solvents such as perchloroethylene (PERC) and trichloroethylene are most widely used in dry-cleaning and are advantageous in terms of being incombustible and inducing little to no damage to fabrics. However, the chlorinated solvents cause air pollution and are considered as being non-biodegradable and carcinogenic.

For this reason, petroleum-based solvents having about 5 to 13 carbon atoms have been recently used, especially a mixture of straight, branched and cyclic hydrocarbons has been used instead of the chlorinated solvents. However, the petroleum-based solvents may cause fires and explosions as well as environmental pollution as a volatile organic compound (VOC) generating ozone. Also, a microbial contamination may occur in the petroleum-based solvents themselves. In addition, stoddard solvent, which is assumed to be a representative hydrocarbon used in dry cleaning, has been known to induce carcinogenesis through inhalation.

In order to solve such problems, various researches have been conducted to develop a solvent for dry-cleaning which is safe on the human body and more environment-friendly.

For example, U.S. Pat. No. 7,087,094 discloses the use of dipropylene glycol n-propyl ether, and U.S. Pat. No. 7,144,850 discloses the use of dipropylene dimethyl ether, as an ethylene glycol ether-based solvent. These ethylene glycol ether-based solvents are relatively harmless to the human body and environment and can contain water in a certain amount. However, a lot of energy and time are needed to dry textiles or clothes due to their high volatilization temperature.

Also, U.S. Pat. Nos. 4,685,930; 6,042,617; and 6,063,135 use a cyclic silicon-based solvent as an environment-friendly solvent. However, such a cyclic silicon is also carcinogenic, has a very low affinity with water, and exhibits very poor removal of liphophilic contaminants.

SUMMARY

The present invention is designed to solve the above problems, and therefore it is an object of at least one embodiment of the present invention to provide a solvent for cleaning textiles or clothes, which has good affinity with water and superior cleaning effects against both water-based and oil-based contaminants, and is non-harmful to the human body and environment to be applied in both water-cleaning and dry-cleaning processes in an unclosed manner, and also leads to easy drying under the conventional cleaning conditions, thereby satisfying several properties suitable for cleaning and eventually being favorably used as a solvent for cleaning.

Another object of at least one embodiment of the present invention is to provide a composition for cleaning, comprising the above-mentioned solvent, and a method of cleaning using the above-mentioned solvent.

In order to achieve the objects as mentioned above, in accordance with one aspect of at least one embodiment of the present invention, there is provided a solvent of formula (I) to be used in the general cleaning or dry-cleaning processes of textiles or clothes:

(I)

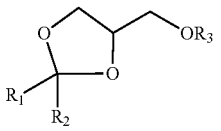

wherein $R_1$ and $R_2$ are each independently hydrogen or $C_{1-4}$ alkyl, and $R_3$ is hydrogen or $C_{1-4}$ alkyl.

The solvent of the present invention is hydrophilic and readily dissolved in water due to its strong affinity with water, while having good cleaning ability against oil-based contaminants. Accordingly, the present invention can solve the difficulty in having to remove water-based contaminants by conventional solvents for dry-cleaning, such as petroleum-based, chlorinated, glycol ester-based, cyclic silicone- or silicone-based, fluorinated, and terpene oil solvents. That is, the solvent of the present invention is amphiphilic and has great ability to contain water, thereby being readily used together with water and a surfactant, and eventually superiorly removing water-based contaminants, as compared with the conventional solvent for dry-cleaning.

Also, the solvent of the present invention can alleviate dangers of explosion or fire, and is less harmful to the human body and environment in terms of its chemical structure, and can provide flexibility to textiles or clothes.

In addition, the solvent of the present invention volatilizes under the conventional drying conditions (e.g., sun drying at 20 to 35° C. for 5 to 8 hours) after cleaning and therefore is not left behind in textiles or clothes, unlike conventional surfactants used in general cleaning. Further, the solvent of the present invention can effectively prevent the distortion of textiles or clothes by the alkalinity of a conventional detergent and water and can easily overcome the conventional detergent's limitation in the removal of liphophilic contaminants.

In the present invention, the compound of formula (I) may be prepared by using glycerols such as acetone, methyl ethyl ketone, methyl isobutyl ketone, butyl aldehyde, but the present invention is not limited thereto.

The solvent of formula (I) according to at least one embodiment of the present invention provides effects more superior than other solvents having similar structure, in terms of the desired objects of the present invention.

The preferred examples of the solvent for cleaning textiles or clothes according to the present invention are as presented in Table 1.

TABLE 1

| Glycerol-Acetone | Glycerol-Methyl Ethyl Ketone Ketal | Glycerol-Methyl Isobuthyl Ketone Ketal | Glycerol-Butylaldehyde Acetal |
|---|---|---|---|
| 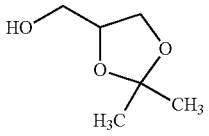 | 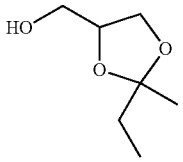 | 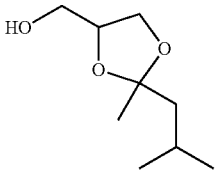 | 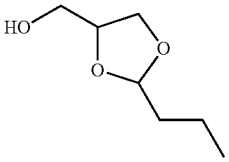 |

Further, the present invention provides a composition for cleaning textiles or clothes, comprising the solvent of the present invention. The composition of the present invention can be readily used to dry clean as well as water clean at home. Accordingly, the present invention also provides a method of cleaning textiles or clothes using the solvent or composition of the present invention.

The composition for cleaning which comprises the solvent of the present invention may further comprise water due to the hydrophilic property of the solvent, the preferred content of water is in the range of 20 wt % or less, more preferably 5 to 10 wt %, based on the total weight of the composition.

The composition for water-cleaning or dry-cleaning according to the present invention can wash textiles or clothes using the solvent itself comprised therein.

The composition for water-cleaning or dry-cleaning according to the present invention may comprise water, a certain amount of components which are used in conventional solvents and laundry detergents for water-cleaning or dry-cleaning, with the purpose of improving the cleaning ability against a certain contaminant, the stability of contents, the safety on the human body and environment, and reducing dangers of explosion or fire. For example, the composition of the present invention may further comprise water with the purpose of improving cleaning ability against a certain contaminant, the stability of contents, the safety on the human body and environment, and of reducing dangers of explosion or fire.

Also, in order to improve cleaning ability against a certain contaminant and improve the safety of contents, the composition for water-cleaning or dry-cleaning according to the present invention may be at least one solvent selected from the group consisting of glycol ether-based solvents such as methyl-, ethyl-, propyl-, butyl- and hexyl-glycol ether; glycol ether ester-based solvents; alcohol-based solvents such as ethanol, hexylene glycol, butanol, propanol and pentanol; ester-based solvents such as n-butyl aceate, isobutyl acetate, n-propyl acetate and isopropyl acetate; ketone-based solvents such as diisobutyl ketone and isophorone; hydrocarbon solvents such as straight, branched, cyclic and aromatic hydrocarbons having 5 to 13 carbon atoms; solvents of fluorides, bromides and carbon chlorides such as trichloroethylene, perchloroethylene and trichloroethane; silicon-based solvents such as a low molecular weight of dimethicone and cyclomethicone; fluoroether-based solvents such as hydrofluoroether and perfluoroisobutyl ether; and glycerin-derived solvents. Such a solvent may be used alone or as a mixture thereof within the range not deteriorating the object of the present invention, but the present invention is not limited to the specific kinds of such a solvent.

In addition, in order to improve a cleaning ability against a certain contaminant and improve the safety of contents, the composition for water-cleaning or dry-cleaning according to the present invention may further comprise at least one of the following components alone or as a mixture thereof within the range not deteriorating the object of the present invention, but the present invention is not limited to the specific kinds of such a component:

i) a surfactant, for example, at least one anionic surfactant selected from the group consisting of soap, alkylbenzene sulfonates, alkane sulfonates, α-olefin sulfonates, α-sulfofatty acid methyl ester, alkyl sulfates and alkyl ether sulfates;

at least one non-ionic surfactant selected from the group consisting of alcohol ethoxlylates, alkylphenol ethoxylates, alkylamine oxides, methyl glucamide and alkyl polyglucosides; at least one cationic surfactant selected from the group consisting of distearyl methyl ammonium chloride, imidazolinium derivatives, alkyl dimethyl benzene ammonium chlorides and esterquat; and at least one amphoteric surfactant selected from the group consisting of alkyl betaines, alkyl sulfobetaines and amino acids, ii) an alkaline agent which contains a metal ion to produce a precipitate, for example, sodium carbonate, calcium carbonate and sodium silicate, iii) an ion exchanger which is soluble or insoluble in water, for example, sodium triphosphate, water-soluble polycarboxylate and zeolite, iv) a bleaching agent, for example, peroxide and hypochlorite, v) a bleach activator, for example, tetraacetylethylenediamine and sodium nonanoyloxybenzene sulfonate, vi) an enzyme component which is effective in the removal of a certain contaminant, for example, proteases, starch degrading enzymes and lipolytic enzymes, vii) an agent for preventing re-contamination, for example, carboxymethyl cellulose and a derivative thereof, carboxymethyl starch, cellulose ether, terephthalic acid, and anionic polymers derived from polyethylene glycol, viii) a fluorescent brightening agent, for example, stilbene, coumarin, bisphenol and distearyl biphenyl, ix) an agent for preventing dye migration, for example, polyvinylpyrrolidone, polyvinylpyridine N-oxide and polyacrylate, x) an antifoaming agent, for example, silica, silicon and paraffin oil, xi) a flavoring agent, and xii) a preservative.

Furthermore, the composition for water-cleaning or dry-cleaning according to the present invention may further comprise other useful components providing useful characteristics, e.g., flexibility, antibiotic property, deodorization, water-repellent property and UV protection, in textiles and clothes, but the present invention is not limited thereto.

The solvent and composition for cleaning according to at least one embodiment of the present invention are effective in the removal of oil-based and water-based contaminants, provide a fast drying rate and are convenient in use. Also, the solvent and composition for cleaning according to the present invention can effectively prevent the distortion of textiles and clothes which are generally caused by the alkalinity of a detergent, the use of water and the long term rough and tumble of a washing machine, and also provide safety on the human body and environment.

BRIEF DESCRIPTION OF DRAWINGS

Other objects and aspects of the present invention will become apparent from the following descriptions of the embodiments with reference to the accompanying drawings in which:

FIG. 1 shows the comparison results of the cleaning ability (WB) of the solvents according to the present invention and conventional solvents for dry-cleaning.

DETAILED DESCRIPTION

Hereinafter, various preferred examples of the present invention will be described in detail for better understanding. However, the examples of the present invention may be modified in various ways, and they should not be interpreted as limiting the scope of the invention. The examples of the present invention are just for better understanding of the invention to persons having ordinary skill in the art.

Examples 1 to 4 and Comparative Examples 1 to 7

Comparison of the Characteristics of Solvents

Solvents listed in Table 2 were evaluated for their cleaning performance and efficiency. Specifically, compounds of formula (I) in which $R_3$ is hydrogen, $R_1$ and $R_2$ are each an alkyl group derived from acetone, ketone, or aldehyde were obtained by the reaction of glycerol and acetone, ketone or aldehyde, and the resulting compounds were each used in Examples 1 to 4.

TABLE 2

| | Comparative Examples | | | | | | | Examples | | | |
|---|---|---|---|---|---|---|---|---|---|---|---|
| | 1 | 2 | 3 | 4 | 5 | 6 | 7 | 1 | 2 | 3 | 4 |
| Water | 100 | | | | | | | | | | |
| Perchloroethylene | | 100 | | | | | | | | | |
| Iso-paraffin | | | 100 | | | | | | | | |
| Decamethyl-cyclopentasiloxane | | | | 100 | | | | | | | |
| 3-Methoxy 1,2-propanol | | | | | 100 | | | | | | |
| 2,3-Dimethoxy-1-propanol | | | | | | 100 | | | | | |
| mono,di,tri-Acetine Mixture | | | | | | | 100 | | | | |
| Acetone Glycerol | | | | | | | | 100 | | | |
| MEK[1)] Glycerol | | | | | | | | | 100 | | |
| MIBK[2)] Glycerol | | | | | | | | | | 100 | |
| BuA[3)] Glycerol | | | | | | | | | | | 100 |

[1)]Methyl ethyl ketone
[2)]Methyl isobutyl ketone
[3)]Butyl aldehyde

<Experimental Method>

Drying Rate

Each solvent used in Comparative Examples 1 to 7 and Examples 1 to 4 was evaluated for its drying rate at room temperature which is considered an important factor in dry-cleaning. The initial weight (A) of standard cotton samples was each measured. After impregnating each solvent or composition in a certain amount into the cotton samples, the weight (B) of the cotton samples was measured. A difference between weight (B) and weight (A) was calculated to determine the weight of each of the impregnated solvents. Then, the cotton samples in which each solvent was impregnated were dried for 8 hours under conditions of room temperature (25° C.) and a relative humidity of 30%. After drying, the weight of each cotton sample was measured and converted into a percentage relative to the initial impregnation weight to obtain a drying rate for each solvent.

Effectiveness in Removing Oil-Based Ink

In order to visually confirm effectiveness in removing oil-based contaminants, an oil-based ink was used for writing on the center of standard white cotton samples (1.3 g), and the cotton samples were each wet with 2 g of a solvent for testing. After wetting, a paper tissue was pressed on the front and back sides of each cotton sample, followed by drying. Then, each spreading degree of the ink was observed visually and through photographs, from which each solvent was evaluated for its ability to remove oil components.

Effectiveness in Cleaning Oil (Water)-Based Contaminants

In order to evaluate effectiveness in cleaning oil (water)-based contaminants quantitatively, a standard contamination fabric according to Japanese Industrial Standard (JIS) (cotton contaminated with oleic acid, triolein, cholesteryl oleate, paraffin oil, etc) and a 10D fabric (cotton contaminated with pigment or sebum), and a 20D fabric (a blend of polyester and cotton, contaminated with pigment or sebum) were used to test each solvent. Such three kinds of fabrics (JIS, 10D and 20D) were each prepared in 8 pieces having a size of 5 cm×5 cm, and each piece was measured for its initial chromaticity using a color difference meter, put into a test solution and shaken 30 times, and then left for 3 minutes. Then, each piece was taken out of the test solution, and the remaining solvent was removed with a tissue. After removing the solvent, sun drying was carried out at room temperature (23 to 25° C.) and a relative humidity of 20 to 30% for 8 hours. Then, chromaticity change was measured using a color difference meter. A change in the value of WB was considered as a change in the cleaning ability against oil (water)-based contaminants. In the case that the contamination fabric tested was not dried completely and the cleaning ability was indicated by a negative integer value, the results thereof was shown as "–".

Solubility in Water

There has been a limitation in the effectiveness of conventional solvents for dry-cleaning in removing water-based contaminants due to the hydrophobic property thereof. Accordingly, in order to relatively evaluate a cleaning effect on the removal of water-based contaminants, the water-containing capacity of solvents according to the present invention was compared with that of the conventional dry-cleaning solvents.

<Results>

Drying Rate and Effectiveness in Removing Oil-Based Ink

The results of evaluations for drying rate and oil-based ink removal are shown in Table 3.

In a drying rate after drying for 8 hours, Example 1 using acetone glycerol as a solvent and Example 2 using MEK glycerol as a solvent were confirmed to be completely dried (100% dry), these results are comparable with those of the conventional dry-cleaning solvents (Comparative Examples 2 and 3) and decamethylcyclopentasiloxane (Comparative Example 4) which is known as an environment-friendly solvent that is not harmful to the human body. Also, the dry characteristic of the solvents used in Examples 1 to 4 was confirmed to be better than that of 3-methoxy-1,2-propanol (Comparative Example 5) and a mixture of mono-, di- and tri-acetin (Comparative Example 7) which are known as an environment-friendly solvent.

In addition, in the cleaning ability against the ink of an oil-based pen, the solvents in the Examples exhibited very superior effectiveness as compared with perchloroethylene, iso-paraffin, decamethylcyclopentasiloxane which have been used as a solvent for dry-cleaning, as well as 3-methoxy-1,2-propanol, 2,3-dimethoxy-1-propanol, and a mixture of mono-, di- and tri-acetin which are known as an environment-friendly solvent.

Cleaning Effectiveness in Contaminated Fabrics

The results of cleaning effectiveness in contaminated fabrics are shown in Table 4 and FIG. 1.

TABLE 4

| | Com. Ex. 1 | Com. Ex. 2 | Com. Ex. 3 | Com. Ex. 4 | Com. Ex. 5 | Com. Ex. 6 | Com. Ex. 7 | Example 1 | Example 2 | Example 3 | Example 4 |
|---|---|---|---|---|---|---|---|---|---|---|---|
| JIS | 14.6 | 53.13 | 35.08 | 22.68 | — | 32.92 | — | 44.97 | 42.85 | 45.13 | 40.62 |
| 10D | 1.23 | 35.41 | 29.32 | 13.09 | — | 12.88 | — | 23.62 | 28.54 | 24.32 | 21.38 |
| 20D | 2.36 | 30.05 | 27.96 | 14.69 | — | 12.99 | — | 25.22 | 24.31 | 22.15 | 27.6 |

As can be seen in Table 4 and FIG. 1, in the results of cleaning effectiveness against oil (water)-based contaminants for three kinds of contaminated fabrics, the solvents used in the Examples of the present invention exhibited very superior cleaning effectiveness as compared with the solvents of Comparative Examples 4 to 7 which have been used as an environment-friendly solvent for dry-cleaning.

Solubility in Water

The results of solubility in water are shown in Table 5.

TABLE 5

| | Com. Ex. 2 | Com. Ex. 3 | Com. Ex. 4 | Example 1 | Example 2 | Example 4 |
|---|---|---|---|---|---|---|
| Solubility (20° C.) | 0.015 g/100 mL | Insoluble | Insoluble | soluble (miscible) | soluble (miscible) | soluble (miscible) |

As can be seen in Table 5, the solvents according to the present invention exhibited very superior water-solubility as compared with three conventional solvents for dry-cleaning, including those of Comparative Examples 2, 3 and 4.

TABLE 3

| | Com. Ex. 1 | Com. Ex. 2 | Com. Ex. 3 | Com. Ex. 4 | Com. Ex. 5 | Com. Ex. 6 | Com. Ex. 7 | Example 1 | Example 2 | Example 3 | Example 4 |
|---|---|---|---|---|---|---|---|---|---|---|---|
| Drying rate (%) | 100 | 100 | 100 | 100 | 10.53 | 95.29 | 1.17 | 100 | 100 | 85.25 | 90.3 |
| Ink cleaning | | | | | | | | | | | |

What is claimed is:

1. A method of cleaning textiles or clothes, comprising wetting the textiles or clothes with a solvent of formula (I):

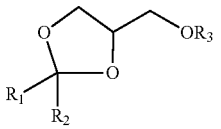

(I)

wherein $R_1$ and $R_2$ are each independently hydrogen or $C_{1-4}$ alkyl, and $R_3$ is hydrogen or $C_{1-4}$ alkyl.

2. The method of claim 1, wherein the wetting step is carried out by dry-cleaning.

3. The method of claim 1, wherein the composition further comprises water.

4. The method of claim 3, wherein water is present in an amount of 20 wt % or less based on the total weight of the composition.

5. The method of claim 1, wherein $R_1$ and $R_2$ are each methyl, and $R_3$ is hydrogen.

6. The method of claim 1, wherein $R_1$ and $R_2$ are methyl and ethyl, respectively, and $R_3$ is hydrogen.

7. The method of claim 1, wherein $R_1$ and $R_2$ are methyl and isobutyl, respectively, and $R_3$ is hydrogen.

8. The method of claim 1, wherein $R_1$ and $R_2$ are butyl and hydrogen, respectively, and $R_3$ is hydrogen.

* * * * *